US006862516B2

(12) United States Patent
Fujimoto

(10) Patent No.: US 6,862,516 B2
(45) Date of Patent: Mar. 1, 2005

(54) FUEL GAS PURGE SYSTEM HAVING FAILURE DIAGNOSTIC FUNCTION IN INTERNAL COMBUSTION ENGINE

(75) Inventor: Shinya Fujimoto, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/704,720

(22) Filed: Nov. 12, 2003

(65) Prior Publication Data

US 2004/0267435 A1 Dec. 30, 2004

(30) Foreign Application Priority Data

Jun. 27, 2003 (JP) ..... P2003-185132

(51) Int. Cl.[7] ..... F02M 25/08

(52) U.S. Cl. ..... 701/107; 701/114; 73/116; 123/520

(58) Field of Search ..... 701/107, 114, 701/115; 123/520, 518, 521; 73/117.3, 116, 118.1

(56) References Cited

U.S. PATENT DOCUMENTS 5,143,035 A * 9/1992 Kayanuma ..... 123/520
6,308,559 B1 * 10/2001 Davison ..... 73/118.1

FOREIGN PATENT DOCUMENTS

| | | | | |
|---|---|---|---|---|
| JP | 5-125997 | | 5/1993 | |
| JP | 9-21359 | * | 1/1997 | ..... F02M/25/08 |
| JP | 9-177617 | | 7/1997 | |
| JP | 11-22564 | | 1/1999 | |
| JP | 11-210569 | | 8/1999 | |
| JP | 2001-12315 | * | 1/2001 | ..... F02M/25/08 |

* cited by examiner

*Primary Examiner*—Hieu T. Vo
(74) *Attorney, Agent, or Firm*—Sughrue Mion, PLLC

(57) ABSTRACT

When detection of malfunction is interrupted for any reason, the integrated purge amount is cleared, and the next malfunction judgment conditions are determined satisfied when said integrated purge amount is not less than a second predetermined value shorter than said first predetermined value. The detection of malfunction is carried out again by purging the canister taking a time shorter than conventionally required. As a result, a fuel gas purge system having failure diagnostic function and being capable of improving frequency in detection of malfunction and preventing deterioration in drivability and emission is obtained.

9 Claims, 9 Drawing Sheets

| TANK INTERNAL TEMPERATURE [℃] | 0 | 10 | 20 | 30 | 40 |
|---|---|---|---|---|---|
| JUDGMENT VALUE CR [s] | 60 | 60 | 100 | 200 | 200 |

FUEL GAS PURGE SYSTEM HAVING FAILURE DIAGNOSTIC FUNCTION IN INTERNAL COMBUSTION ENGINE

BACKGROUND OF THE INVENTION

1. Field of the Invention

The present invention relates to a system for making a diagnosis whether there is failure in a fuel gas purge system for purging (discharging) fuel evaporative gas adsorbed in a canister to an intake pipe of an internal combustion engine.

2. Description of the Related Art

In a conventional failure diagnostic device of a fuel gas purge system, conditions on which a purge-execution-integrated time or an integrated purge amount after starting of the internal combustion engine reaches a predetermined value are added to failure diagnostic conditions. These additional conditions are used to judge whether or not the canister is sufficiently purged, and failure diagnosis is made when an amount of fuel evaporative gas remaining in the canister is sufficiently small. This prevents production of an over-rich mixture caused by fuel evaporative gas flowing into the intake pipe during the failure diagnosis, thereby preventing deterioration in drivability and emission (for example, see the Japanese Patent Publication (unexamined) No. 1997-177617). Another conventional failure diagnostic device of a fuel gas purge system of the same type is disclosed in, for example, the Japanese Patent Publication (unexamined) No. 1999-22564.

In the mentioned conventional failure diagnostic device of a fuel gas purge system, however, when detection of malfunction is once interrupted for any reason and carried out again, the resumed purge takes the same time as long as the purge-execution-integrated time of the canister. Hence a problem exists in that it is not possible to carry out detection of malfunction at a higher frequency.

SUMMARY OF THE INVENTION

The present invention was made to solve the above-discussed problem and has an object of obtaining a system in which, when detection of malfunction is interrupted for any reason, the detection of malfunction is carried out again by purging the canister taking a time shorter than conventionally required, thereby improving frequency in detection of malfunction and preventing deterioration in drivability and emission.

The invention has another object of obtaining a system in which upon judging that fuel is supplied, production of over-rich mixture caused by inflow of fuel evaporative gas during supply of fuel is prevented, thereby preventing deterioration in drivability and emission.

The invention has a further object of obtaining a system in which if a time during which purge air is not introduced by a purge control valve continues not shorter than a predetermined time, the integrated purge amount is cleared in order to prevent production of over-rich mixture caused by inflow of a large amount of fuel evaporative gas and prevent deterioration in drivability and emission.

A fuel gas purge system having failure diagnostic function in an internal combustion engine according to the invention includes: a fuel transpiration-preventing device that adsorbs fuel gas produced in a fuel tank into an adsorbent of a canister disposed in the middle of a purge passage communicating the fuel tank to an intake pipe and opens and closes a purge control valve based on operating conditions of the internal combustion engine in order to introduce the adsorbed fuel gas into the intake pipe, thereby preventing transpiration of fuel; plural sensors that detect operating conditions of the mentioned internal combustion engine; first malfunction judgment condition detecting means that detects satisfaction of first malfunction judgment conditions of the mentioned fuel transpiration-preventing device on the basis of operating condition information from the mentioned plural sensors; an atmospheric air port blocking valve that blocks an atmospheric air port disposed on the mentioned canister; sealing means that closes both of the mentioned purge control valve and atmospheric air port blocking valve and transforms the mentioned fuel transpiration-preventing device into a hermetically sealed section as a whole; integrated purge amount measuring means that measures a integrated purge amount on the basis of an integrated time during which the mentioned purge control valve is subject to open control or a purge integrated flow rate based on the mentioned open control; second malfunction judgment condition detecting means that detects that second malfunction judgment conditions are satisfied when the mentioned first malfunction judgment conditions are satisfied and the integrated purge amount after starting the internal combustion engine is not less than a first predetermined value; a fuel tank internal pressure sensor that detects an internal pressure in the mentioned fuel tank; and malfunction detecting means that detects any malfunction in the mentioned fuel transpiration-preventing device on the basis of a result detected by the mentioned fuel tank internal pressure sensor.

When detection of malfunction is interrupted after the mentioned second malfunction judgment conditions are satisfied, the mentioned integrated purge amount is cleared, and the next second malfunction judgment conditions are determined satisfied when the mentioned integrated purge amount is not less than a second predetermined value that is shorter than the mentioned first predetermined value.

As a result, in the fuel gas purge system having failure diagnostic function in an internal combustion engine according to the invention, when detection of malfunction is interrupted, purging the canister is executed for a time shorter than a conventionally required time, and then detection of malfunction is carried out again. Therefore it is now possible to carry out detection of malfunction at a higher frequency and prevent deterioration in drivability and emission.

Further, if fuel supply judging means judges that fuel has been supplied, the mentioned second malfunction judgment conditions are judged satisfied when the mentioned integrated purge amount is not less than a second predetermined value that is not smaller than the mentioned first predetermined value. As a result, when it is judged that fuel is supplied, this system can prevent production of any over-rich mixture caused by inflow of fuel evaporative gas during the supply of fuel, thereby preventing deterioration in drivability and emission.

Furthermore, the system is provided with means for clearing the mentioned integrated purge amount when a period of time during which any purge is not executed by the mentioned purge control valve continues not shorter than a predetermined time. As a result, in the case where detection of malfunction is started under the condition that the canister is insufficiently purged and the purge control valve is opened to introduce intake pipe negative pressure into the fuel gas purge system, it is now possible to prevent that a relatively large amount of fuel evaporation gas remaining in the canister flows into the intake pipe. Thus it is possible to prevent deterioration in drivability and emission caused by any over-rich mixture.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIGS. 2, 3, and 4 show a complete flowchart in combination thereof.

FIGS. 2, 3, and 10 show a complete flowchart in combination thereof.

DESCRIPTION OF THE PREFERRED EMBODIMENTS

Embodiment 1.

Figure 1:
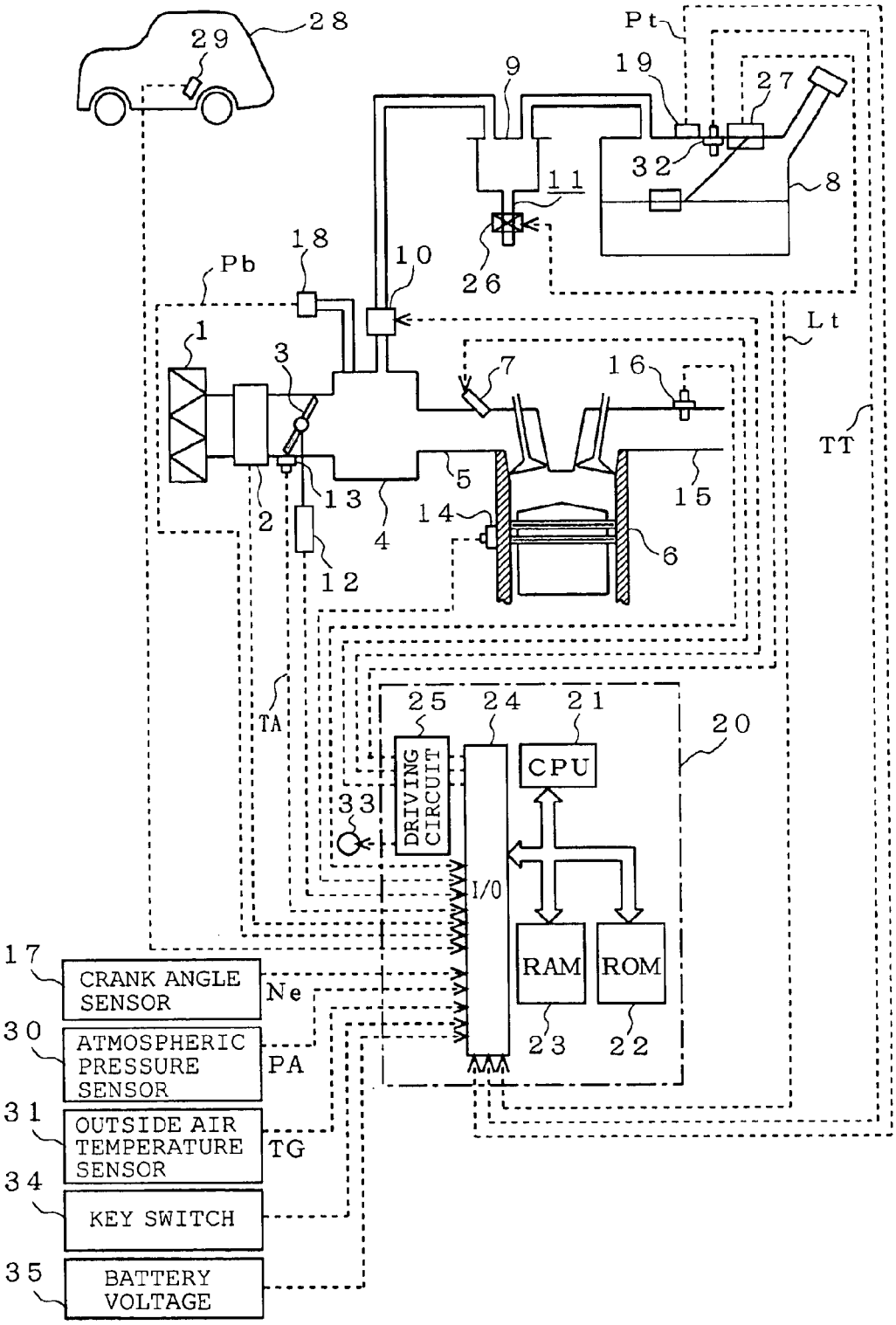
FIG. 1 is a schematic diagram showing a fuel gas purge system having failure diagnostic function according to Embodiment 1 of the present invention.

FIG. 1 is a schematic diagram showing a fuel gas purge system having failure diagnostic function according to Embodiment 1 of the invention. In FIG. 1, air is sucked in through an air cleaner 1 for air filtering, and an intake air amount Qa is measured by an airflow sensor 2 connected to the air cleaner 1. A throttle valve 3 controls the intake air amount conforming to a load, and the air is taken into each cylinder of an engine 6 through a surge tank 4 and an intake pipe 5. The airflow sensor 2 measures the intake air amount supplied to the engine 6 through the intake pipe 5, and inputs the measured value to an electrical control unit (hereinafter referred to as 'ECU') 20. The throttle valve 3 adjusts the intake air amount to the engine 6 in response to the driver stepping on the accelerator pedal.

Each cylinder of the intake pipe 5 is provided with an injector 7, and this injector 7 injects fuel in a fuel tank 8 to the intake pipe 5. The intake pipe 5 is communicated to the fuel tank 8 through a fuel transpiration-preventing device associated with various sensors. For the purpose of detecting operating conditions of the engine 6 (such as engine speed: number of revolutions Ne, loaded condition: charging efficiency Ec, and so on), the plural sensors include the air flow sensor 2, a throttle-opening sensor 12, an intake air temperature sensor 13, a water temperature sensor 14, an air-fuel ratio sensor (an $O_2$ sensor) 16, a crank angle sensor 17, an intake pipe pressure sensor 18, a fuel tank internal pressure sensor 19, a fuel level gauge (fuel level detector) 27, a speed sensor 29, an atmospheric pressure sensor 30, an outside air temperature sensor 31, and a fuel tank internal temperature sensor 32.

The throttle-opening sensor 12 is arranged on a rotary shaft of the throttle valve 3 and detects throttle opening. The intake air temperature sensor 13 is disposed on the intake pipe 5 and detects an intake air temperature TA. The water temperature sensor 14 detects cooling water temperature of the engine 6. The air-fuel ratio sensor 16 is disposed on the exhaust pipe 15 of the engine 6 and generates an air-fuel ratio feedback signal. The crank angle sensor 17 generates a crank angle signal corresponding to the engine speed of the engine 6 (number of revolutions Ne). The intake pipe pressure sensor 18 is disposed on the surge tank 4 of the intake pipe 5 and detects an intake pipe pressure Pb in the intake pipe 5. The fuel tank internal pressure sensor 19 is disposed on the fuel tank 8 and detects a fuel tank internal pressure Pt. The fuel level gauge 27 detects a fuel level Lt in the fuel tank 8.

The speed sensor 29 is disposed in the vicinity of an axle of a vehicle 28 equipped with the engine 6 and detects speed of the vehicle. The atmospheric pressure sensor 30 detects pressure of the outside air as an atmospheric pressure PA. The outside air temperature sensor 31 detects an outside temperature TG. The fuel tank internal temperature sensor 32 detects a fuel gas temperature TT in the fuel tank 8. Information detected by each of the mentioned plural sensors is inputted to the ECU 20 as information representing the operating conditions.

The fuel transpiration-preventing device is comprised of a canister 9 disposed in the purge passage, a purge control valve 10 disposed in the middle of a passage between the canister 9 and the intake pipe 5, and fuel transpiration preventing and con trolling means for preventing fuel transpiration (included in the ECU 20) by opening and closing control of the purge control valve 10. The purge passage communicates the fuel tank 8 to the intake pipe 5. The canister 9 includes activated charcoal as an adsorbent. The canister 9, which contains activated charcoal serving as an adsorbent, is disposed in the middle of the purge passage and adsorbs fuel gas produced in the fuel tank 8. The canister 9 is provided with an atmospheric air port 11, and this atmospheric air port 11 is open to the air through an atmospheric air port control valve 26. The atmospheric air port control valve 26 is associated with the ECU 20 and comprises atmospheric air port blocking means, and opens and closes the atmospheric air port 11 under the control of the ECU 20.

The fuel transpiration preventing and controlling means for in the ECU 20 opens and closes the purge control valve 10 based on the operating conditions of the engine 6 and prevents transpiration of fuel by appropriately introducing fuel gas adsorbed by the canister 9 into the intake pipe 5. In other words, the fuel transpiration preventing and controlling means opens the purge control valve 10 conforming to the purge valve control amount (duty control amount corresponding to the purge amount) that is determined on the operating conditions of the engine 6 in order that the fuel gas adsorbed by the canister 9 may be purged into the intake pipe 5 utilizing negative pressure in the intake pipe 5. At the time of passing through the activated charcoal in the canister 9, the air introduced into the canister 9 through the atmospheric air port control valve 26 and the atmospheric air port 11 is purged into the intake pipe 5 in the form of an air containing fuel gas eliminated from the activated charcoal (purge air).

The ECU 20 is comprised of a microcomputer having a CPU 21, a ROM 22 and RAM 23, and carries out various kinds of control such as air-fuel ratio feedback control of the engine 6, fuel injection control, fuel gas purge control, failure diagnosis of the fuel gas purge system, ignition timing control, etc. An input/output interface 24 in the ECU 20 receives detection information from the various sensors and outputs a control signal to each actuator through a driving circuit 25. In other words, the CPU 21 in the ECU 20 carries out air-fuel ratio feedback control calculation on the basis of a control program and various maps stored in the ROM 22, and drives the injector 7 through the driving circuit 25.

The ECU 20 carries out a known engine control such as ignition timing control of the engine 6, exhaust gas recirculation (EGR) control, and idling engine speed control conforming to the operating conditions, and opens and closes the purge control valve 10 and the atmospheric air port control valve 26. Further, the ECU 20 has fuel gas concentration detecting means that detects concentration of the fuel gas introduced from the canister 9 to the intake pipe and calculates a concentration of the fuel gas of the purge air on the basis of the amount of the purge air sucked into the engine 6 and the operating conditions containing the air-fuel ratio feedback signal. The EUC 20 has integrated purge amount measuring means for measuring an integrated purge amount on the basis of the integrated time during which the purge control valve 10 is open.

The ECU 20 has atmospheric air port blocking means that controls the atmospheric air port control valve 26 and blocks the atmospheric air port 11, sealing means that blocks both of the purge control valve 10 and the atmospheric air port 11 and makes the entire fuel transpiration-preventing device airtight, and first malfunction judgment condition detecting means that detects satisfaction of the conditions (malfunction judgment conditions) and judges whether or not there is any malfunction of the fuel transpiration-preventing device based on the operating conditions. Further, the ECU 20 has integrated purge amount measuring means that controls the opening or closing amount of the purge control valve 10 conforming to the intake pipe pressure Pb and measures the purge amount when the malfunction judgment conditions of the first malfunction judgment condition detecting means are satisfied. Furthermore, the ECU 20 has malfunction detecting means that detects malfunction of the fuel transpiration-preventing device on the basis of the fuel tank internal pressure Pt corresponding to the purge amount at the time when the malfunction judgment conditions are satisfied. When the fuel gas purge system has fallen into any trouble (got out of order), a warning lamp 33 lights to warn the driver of the trouble. Information on a key switch 34 and a battery voltage 35 is inputted to the ECU 20.

Figure 2:
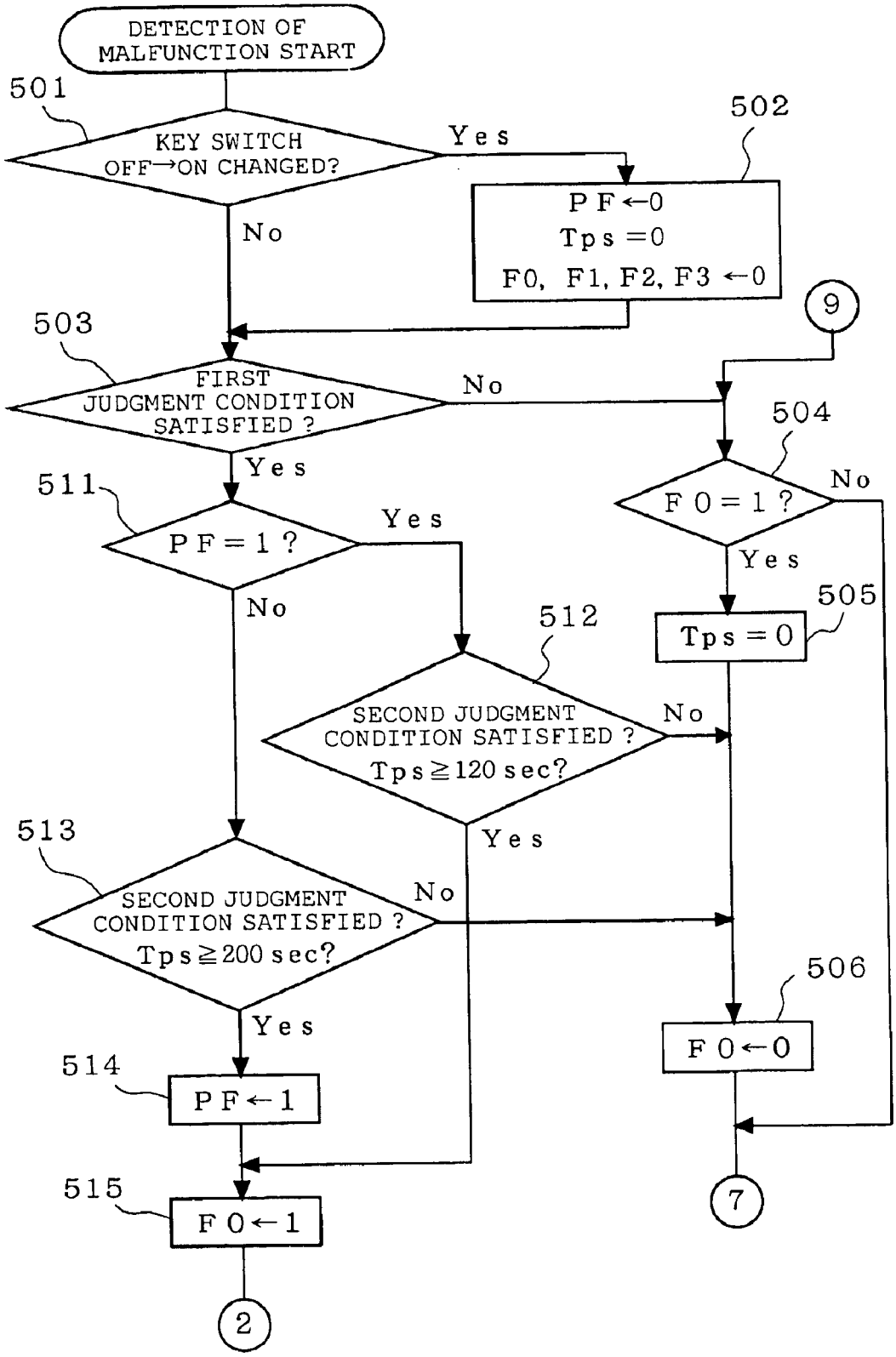
FIG. 2 is a part of a flowchart showing failure diagnosis of the fuel gas purge system according to Embodiment 1.
Figure 3:
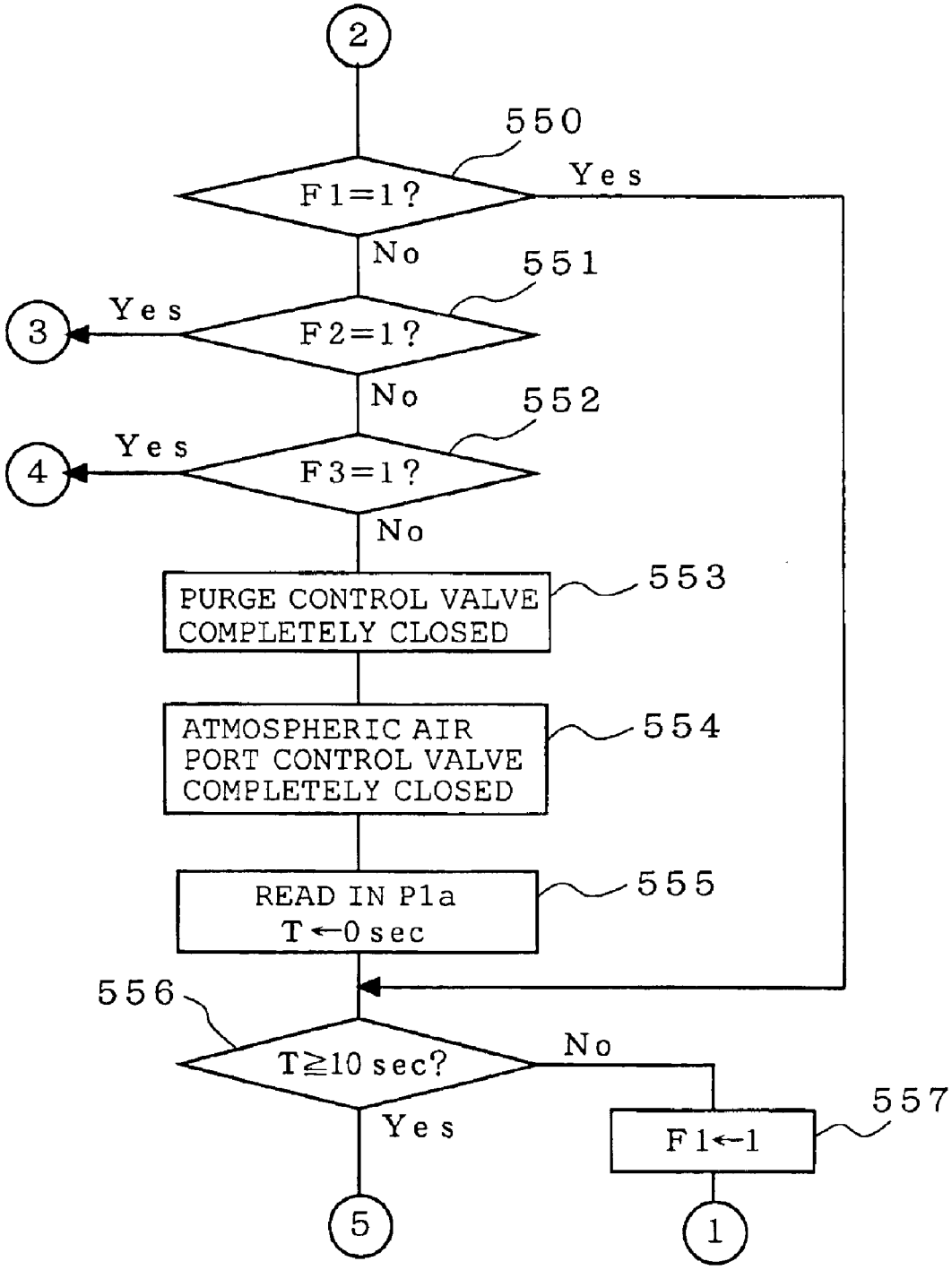
FIG. 3 is a part of the flowchart showing failure diagnosis of the fuel gas purge system according to Embodiment 1.
Figure 4:
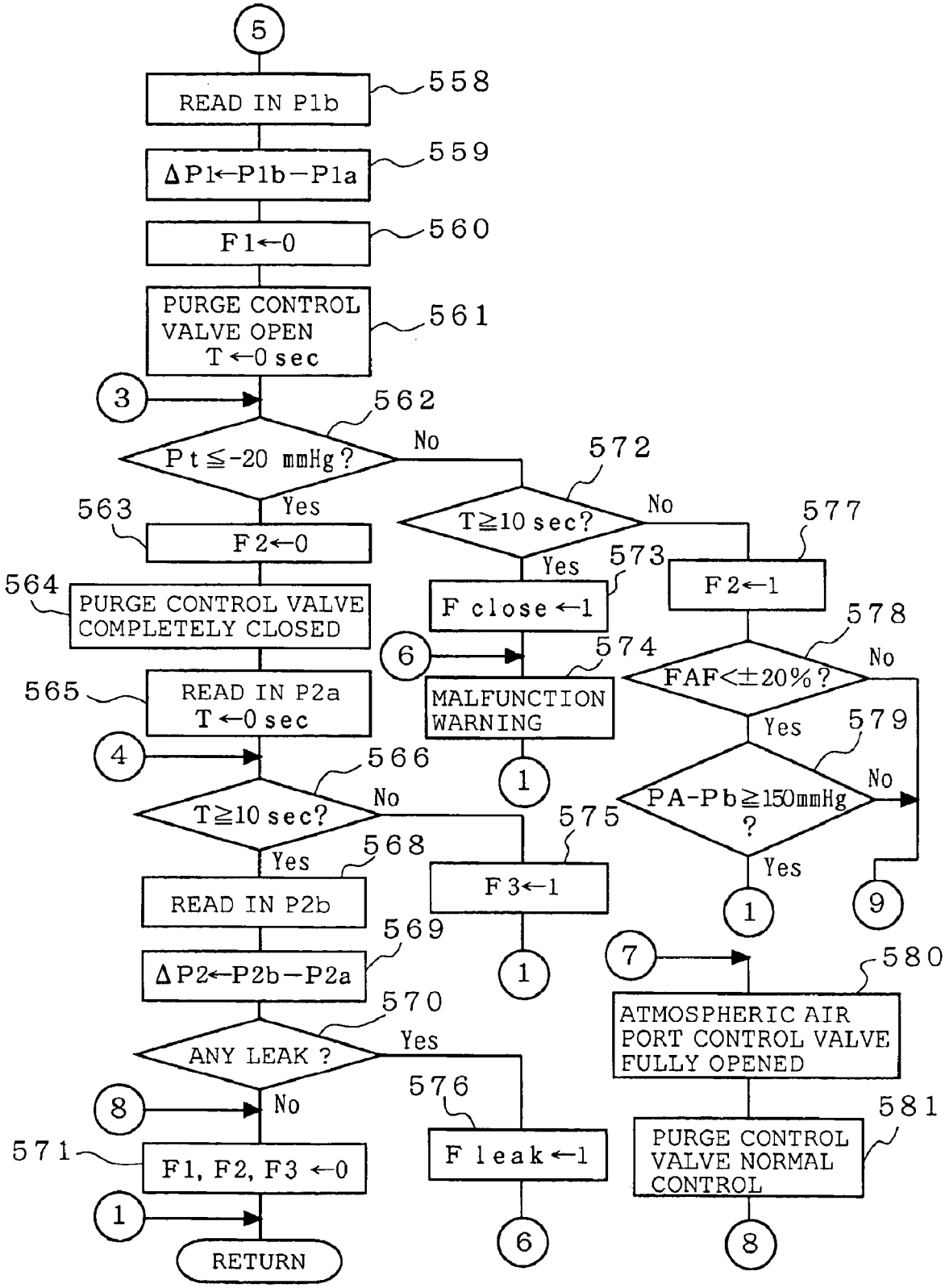
FIG. 4 is a part of the flowchart showing failure diagnosis of the fuel gas purge system according to Embodiment 1.
Figures 5, 6:
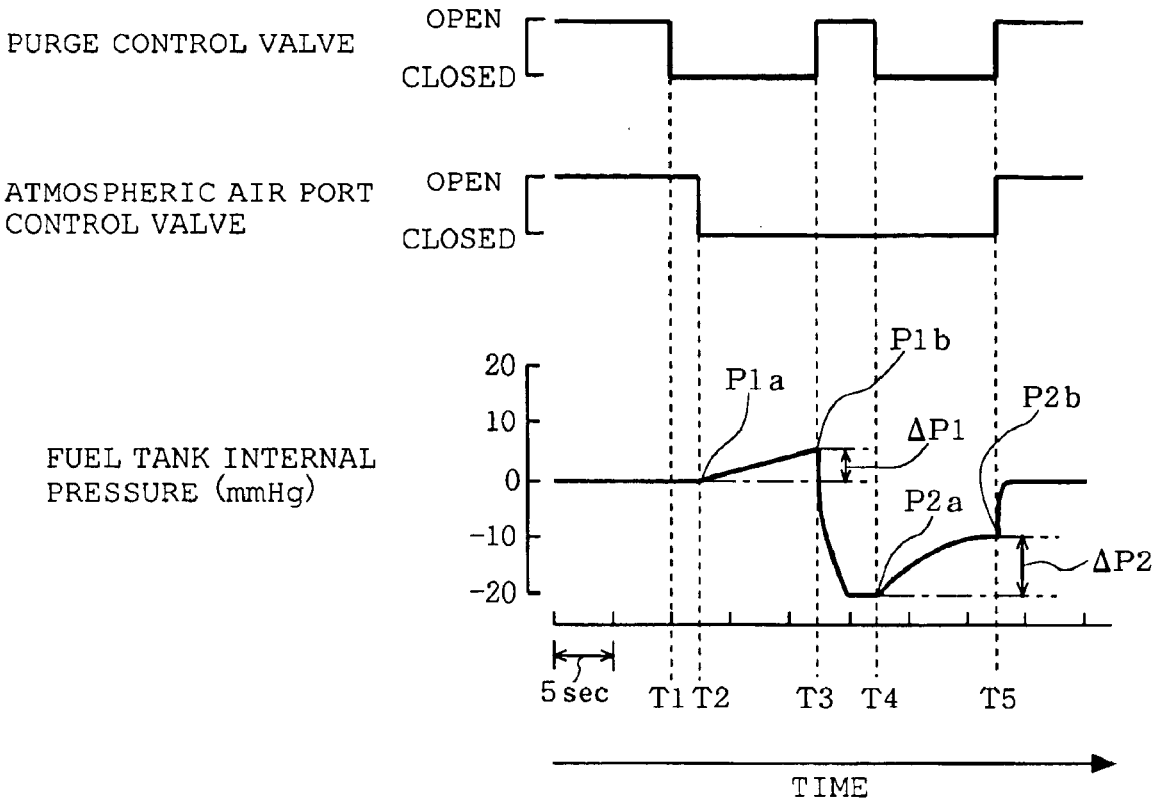
FIG. 5 is a time chart for explaining a relation between opening and closing of a purge control valve and an atmospheric air port control valve at the time of failure diagnosis and change in fuel tank internal pressure.
FIG. 6 is a table showing purge-execution time (judgment value) [s] with respect to tank internal temperature [° C.] according to Embodiment 2.

Described hereinafter is a manner of performing failure diagnosis of the fuel gas purge system. In this Embodiment 1, especially in the case where detection of malfunction is interrupted after passage of a purge-execution-integrated time (or a integrated purge amount) required after starting the engine, detection of malfunction is carried out again after the canister is subject to purging for a period of time shorter than the initially required purge-execution-integrated time so that detection of malfunction is carried out at a higher frequency. FIGS. 2, 3 and 4 are flowcharts showing failure diagnosis of the fuel gas purge system in this Embodiment 1, and FIGS. 2, 3 and 4 form a complete flowchart in combination. FIG. 5 is a time chart for explaining a relation between opening and closing of the purge control valve and the atmospheric air port control valve and change in fuel tank internal pressure during the failure diagnosis.

When turning the key switch 34 on, failure diagnosis of the fuel gas purge system is repeatedly carried out at intervals of a predetermined time (for example, every 25 msec) according to the flowchart of FIGS. 2, 3 and 4. More specifically, referring to FIG. 2, operation of the failure diagnostic routine starts (detection of malfunction starts) and when detecting a change from OFF to ON of the key switch (step 501, Yes), operation of step 502 is carried out, and the process proceeds to step 503.

In step 502, the purge-execution-integrated time and flags are set to be

PF←0,

Purge-execution-integrated time Tps=0, and

F0, F1, F2, F3←0.

where: PF is a flag showing whether or not it is the first time since changing the key switch from off to on, and PF=0 indicates that it is the first time.

Tps is a purge-execution-integrated time and Tps=0 indicates that the purge-execution-integrated time is set to 0.

F0 is a flag showing whether or not detection of malfunction is going on (the second malfunction judgment conditions are satisfied), and F0=0 indicates that the conditions are not satisfied.

F1, F2 and F3 are flags each showing a level of detection of malfunction, and 0 indicates the initial condition, i.e., indicates that the operation of detection of malfunction has not reached the level yet.

In step 501, the process proceeds to 'Yes' if the key switch is changed from OFF to ON while the process proceeds to 'No' if the key switch continues being ON, then the process proceeds to step 503.

In step 503 (the first malfunction judgment condition detecting means), whether or not the first malfunction judgment conditions are satisfied is detected. In this step, the first malfunction judgment conditions are satisfied when the operating conditions of the engine is stable. More specifically, the judgment conditions include intake air amount=5.0 to 40 g/s, intake air temperature=−10 to 70° C., cooling water temperature at the time of engine start=−7.5 to 35° C., passage of not shorter than 700 seconds since the engine start, battery voltage of not less than 10 V, and air-fuel ratio feedback going on. If all of those conditions are satisfied, the first malfunction judgment conditions are satisfied, and the process proceeds to step 511. On the other hand, if the first malfunction judgment conditions are not satisfied, failure diagnosis is inhibited and the process proceeds to step 504. In step 504, whether or not F0=1 (detection of malfunction is going on) is checked, and when detecting that detection of malfunction is not carried out (step 504, No), the process proceeds to step 580 (FIG. 4). If F0 =1 (detection of malfunction is going on) in step 504 (step 504, Yes), the purge-execution-integrated time is set again to be Tps =0 (step 505), the flag is reset to be F0←0 (the conditions are not satisfied) (step 506), and the process proceeds to step 580 (FIG. 4).

When the process proceeds to step 580 in FIG. 4, the atmospheric air port control valve 26 is fully opened, and after the purge control valve 10 is put under normal control (step 581), the process proceeds to step 571. The first to third flags F1, F2 and F3 are reset to '0', thus this routine comes to end.

When starting again the operation of failure diagnostic routine (start of detection of malfunction), if the key switch continues being ON, the judgment in step 501 is 'No', and the process proceeds to step 503. When the first malfunction judgment conditions are satisfied (step 503, Yes), whether or not PF=1 (not the first time) is checked. If it is the first judgment (step 511, No), the process proceeds to step 513 (the second malfunction judgment condition detecting means). Whether the canister 9 is sufficiently purged or not is judged based on whether or not the purge-execution-integrated time (integrated time when the purge control valve 10 is open) after starting the engine comes to reach a predetermined time (for example, 200 seconds). If the judgment in step 513 is 'No', i.e., if the purge is insufficient, failure diagnosis is inhibited. Then the flag is reset to be F0←0 (the conditions are not satisfied) in step 506 and the process proceeds to steps 580→581→571 in the same manner, and this routine comes to end. In this example, the second malfunction judgment conditions of whether or not the canister 9 is sufficiently purged is carried out by measuring the integrated purge amount on the basis of the purge-execution-integrated time after starting the engine. It is also preferable to judge whether or not the canister 9 is sufficiently purged by measuring the integrated purge amount on the basis of the integrated purge flow after starting the engine.

Next, if the canister 9 is sufficiently purged (step 513, Yes), it is judged PF←1 (not the first time) (step 514), and it is further judged F0←1 (detection of malfunction is carried out) (step 515). Then the process proceeds to steps 550 to 552 in FIG. 3, and while judging that to which stage the process has come at this point of time, the process branches into various steps. The process consists of first to fourth stages, and the operation stage can be judged from the state of the first to third flags F1 to F3 being set. When all the flags F1 to F3 are set to '0', i.e., when it is judged 'No' in all the steps 550 to 552, the process remains in the first stage and proceeds to step 553.

In the first stage, after completely closing the purge control valve 10 (step 553), the atmospheric air port control valve 26 is completely closed (step 554), whereby the purge passage from the fuel tank 8 to the intake pipe 5 is hermetically sealed. That is, as shown in FIG. 5, the purge control valve 10 is completely closed at time T1 under the state that the atmospheric air port control valve 26 is open. Thus the purge passage from the fuel tank 8 to the purge control valve 10 is kept under the same pressure as the atmospheric pressure through the atmospheric air port 11. Then the atmospheric air port control valve 26 is completely closed with a little delay at time T2. Thus a hermetically sealed purge passage kept under the atmospheric pressure is formed.

In the next step 555, the fuel tank internal pressure P1*a* at the time T2 in FIG. 5 is read in. After resetting the timer T to start, the process proceeds to step 55.6, where whether or not the count value of the timer T has reached not less than 10 seconds is judged. If 10 seconds have not passed yet, the process proceeds to step 557. The first flag F1 is set to '1', and this routine comes to end.

Thereafter, the process proceeds to the second stage. In this second stage, it is judged 'Yes' in step 550. At this stage, when starting the process of failure diagnostic routine again, the process proceeds to steps 501→503→511. When PF=1 (not the first time) in step 511, the process proceeds to step 512. In step 512, (because Tps is not shorter than 200 seconds in the previous step 513,) the condition that Tps is not less than 120 seconds is continuously satisfied, the process proceeds to steps 515→550→556 →. . . , and this process is repeated. In the meantime, the value detected by the fuel tank internal pressure sensor 19 rises from 0 mmHg according to the amount of fuel evaporative gas produced in the fuel tank 8 during the period from time T2 to time T3 in FIG. 5.

Subsequently, when 10 seconds have passed from the time T2 (the time of detecting P1*a*), the process proceeds to step 558 in FIG. 4. The input signal from the fuel tank internal pressure sensor 19 is read in, and fuel tank internal pressure P1*b* at this point of time is stored. In the following step 559, after calculating the pressure change amount ΔP1 in the 10 seconds, the first flag F1 is reset in step 560. Thus the process in the second stage comes to end, and the process proceeds to the third stage.

At this third stage, in step 561, the purge control valve 10 is changed from the completely closed state to a fully opened state and the timer T is reset to start. In this step, when the purge control valve 10 is fully opened, introduction of the intake pipe negative pressure into the hermetically sealed purge passage is started under the atmospheric pressure of the previous step (time T3 in FIG. 5). Accordingly, if the purge passage does not have any trouble caused by pressure leak or the like, detection value of the fuel tank internal pressure sensor 19 begins to fall.

In the next step 562, whether or not the fuel tank internal pressure Pt is not higher than −20 mmHg is judged on the basis of the input signal from this fuel tank internal pressure sensor 19. If Pt>−20 mmHg, the process proceeds to step 572, and whether or not 10 seconds have passed since the purge control valve 10 was fully opened is judged. If 10 seconds have not passed yet, the process proceeds to step 577 and the second flag F2 is set to '1'. Subsequently, in step 578, whether or not the air-fuel ratio correction coefficient FAF is within ±20% is judged. If FAF is within ±20%, the process proceeds to step 579 and whether or not differential pressure between the atmospheric pressure PA and the intake pipe pressure Pb is not less than a predetermined value (for example, 150 mmHg) is judged.

If it is judged 'No' in either step 578 or 579, i.e., when the air-fuel ratio correction coefficient FAF exceeds by ±20%, or when differential pressure between the atmospheric pressure PA and the intake pipe pressure Pb is less than the predetermined value (for example, 150 mmHg), the process proceeds to step 504. On the other hand, in the case where it is judged 'Yes' in either step 578 or 579, this routine comes to end.

In this case, as a result of setting the second flag F2 to '1' in step 577, on and after when this routine is carried out, it is judged 'No' in step 550, and it is judged 'Yes' in step 551, and the operation in order of steps 501→503→511→512→515→550 →551→ step 562→ . . . is repeated. This situation comes to end when it is judged 'Yes' in step 562 or step 572. In the case where 'Yes' in step 572 is earlier than 'Yes' in step 562, this means that there is a choked portion somewhere in the purge passage from the fuel tank 8 to the intake pipe 5. Thus, a purge system choke flag Fclose is set to '1' in step 573, and the warning lamp 33 lights in the subsequent step 574.

On the other hand, in the case where 'Yes' instep 562 is earlier than 'Yes' in step 572, the process proceeds to step 563, and the second flag F2 is reset. In the following step 564, after completely closing the purge control valve 10 is completely closed again. Subsequently, in step 565, the input signal from the fuel tank internal pressure sensor 19 is read in, the fuel tank internal pressure P2*a* immediately after bringing the purge passage into a hermetically sealed negative pressure is stored, and the timer T is reset to start. Thus the process shifts from the third stage to the fourth stage.

As a result of carrying out the foregoing steps 563 to 565, inside of the hermetically sealed purge passage is adjusted to come under negative pressure of −20 mmHg at time T4 as shown in FIG. 5. On and after this time, the value detected by the fuel tank internal pressure sensor 19 rises from −20 mmHg conforming to the amount of fuel evaporative gas produced in the fuel tank 8 during the period from time T4 to time T5.

In the next step 566, after reading P2*a* in, whether or not 10 seconds have passed is judged. If 10 seconds have not passed yet, the process proceeds to step 575, the third flag F3 is set to '1', and this routine comes to end. Consequently, on and after when this routine is carried out, it is judged 'No' in steps 550 and 551, and it is judged 'Yes' in step 552, and the operation in order of steps 501 to 552→ step 566− . . . is repeated.

Thereafter, when 10 seconds have passed since P2*a* was read in, the process proceeds to step 568, in which the input signal from the fuel tank internal pressure sensor 19 is read in, and fuel tank internal pressure P2*b* at time T5 is stored. Then a pressure change amount ΔP2 (=P2*b*−P2*a*) during the 10 seconds since the purge passage was hermetically sealed is calculated (step 569). Subsequently, whether or not there is any leak is judged on the basis of leak judgment conditions shown in the following Expression (1).

$$\Delta P2 > \alpha \cdot \Delta P1 + \beta \ldots \quad (1)$$

where: α is a coefficient for correcting a difference in fuel evaporation amount caused by a difference between the atmospheric pressure and the negative pressure. β is a coefficient for correcting detection accuracy of the fuel tank internal pressure sensor 19, pressure leak of the atmospheric air port control valve 26, and so on.

If the foregoing expression (1) is satisfied, it is judged that 'there is a leak'. In other words, if the leak is caused in the hermetically sealed section from the fuel tank 8 to the purge control valve 10, the air flows out from the hermetically sealed section to the atmospheric air under positive pressure, while the air flows in from the atmospheric air to the hermetically sealed section under negative pressure. Therefore, [(pressure change amount ΔP2 under negative pressure)=(amount of fuel evaporative gas generated from the fuel tank 8) +(amount of air flowing in from the atmospheric air to the hermetically sealed section)] is larger than [(pressure change amount ΔP1 under atmospheric pressure)=(amount of fuel evaporative gas generated from the fuel tank 8)−(amount of air flowing out from the hermetically sealed section to the atmospheric air)]. The leak judgment conditions shown in the foregoing expression (1) are derived from this relation.

In the case where the leak judgment conditions shown in the foregoing expression (1) are satisfied, i.e., when it is judged that 'there is any leak' in step 570, this means that there is any cause of the leak somewhere in the purge passage from the fuel tank 8 to the intake pipe 5, and a purge passage leak flag Fleak is set to '1' in step 576, and the warning lamp 33 lights in the subsequent step 574. On the other hand, in the case where it is judged 'No' in step 570, i.e., when there is no leak, the process proceeds to step 571. All the first to third flags F1 to F3 are compulsorily reset, thus this routine comes to end.

Described below is a case where detection of malfunction is stopped when F0=1 (detection of malfunction is going on), i.e., after satisfaction of the second malfunction judgment conditions in step 513. When F0=1 (during detection of malfunction going on), if the first malfunction judgment conditions are not satisfied (i.e., if it is judged 'No' in step 503), if the air-fuel ratio correction coefficient FAF exceeds by ±20% (i.e., if it is judged 'No' in step 578), or if the differential pressure between the atmospheric pressure PA and the intake pipe pressure Pb is less than a predetermined value (for example, 150 mmHg) (i.e., if it is judged 'No' in step 579), then the process proceeds to step 504. Since F0 =1 (detection of malfunction is going on) in step 504, the purge-execution-integrated time is reset to be Tps=0 (step 505), the flag is set to be F0←0 (the conditions are not satisfied). The process proceeds to steps 580→581→571 and this routine comes to end, and the foregoing process is repeated.

Subsequently, the operation of failure diagnostic routine is started, and the process proceeds to steps 501→503. If the first malfunction judgment conditions are satisfied (or become satisfied) in step 503, the process proceeds to step 511. In this step, since PF=1 (not the first time), the process proceeds to step 512. When Tps reaches 120 sec, the flag is set to be F0←1, and the similar detection of malfunction is operated on and after this time.

In other words, in this case, since detection of malfunction was interrupted after passing the purge-execution-integrated time (or the integrated purge amount) required after starting the engine, detection of malfunction is carried out again after purging the canister for a period of time (for example, 120 sec) shorter than the initial required purge-execution-integrated time (for example, 200 sec) in order that detection of malfunction is carried out at a higher frequency.

If it is judged 'Yes' in both step 578 and 579 during carrying out the process, operation of failure diagnostic routine starts again, and the process proceeds to steps 501→503→511. Since PF=1 (not the first time) in the same manner, the process proceeds to step 512. Since Tps has already reached 120 sec, the flag is set to be F0←1, and the similar detection of malfunction is executed on and after this time.

In other words, in this case also, detection of malfunction was interrupted after passing the purge-execution-integrated time (or the integrated purge amount) required after starting the engine, and therefore detection of malfunction is carried out again after purging the canister for a period of time (for example, 120 sec) shorter than the initial required purge-execution-integrated time (for example, 200 sec) in order that detection of malfunction is carried out at a higher frequency.

In step 579, since failure diagnosis is carried out when the differential pressure between the atmospheric pressure and the intake pipe pressure during failure diagnosis is not less than a predetermined value, the intake pipe negative pressure is sufficiently introduced into the fuel gas purge system during failure diagnosis. This further improves accuracy in failure diagnosis.

In step 513, failure diagnosis is carried out when the purge-execution-integrated time (or the integrated purge amount) after starting the engine is not less than a predetermined value, failure diagnosis can be carried out when amount of fuel evaporation gas remaining in the canister is sufficiently small, and amount of fuel evaporation gas flowing into the intake pipe during the failure diagnosis can be reduced. This prevents deterioration in drivability and emission caused by the over-rich mixture.

In step 578, failure diagnosis is carried out when the air-fuel ratio feedback correction amount remains within a predetermined value and the air-fuel ratio control is stable. This prevents production of the over-rich mixture caused by failure diagnosis and prevents deterioration in drivability and emission.

In step 503, failure diagnosis is carried out when the operating conditions of the internal combustion engine is stable. This prevents deterioration in drivability and emission more as compared with the case where failure diagnosis is carried out under the unstable operating conditions.

In this Embodiment 1, in the case where detection of malfunction is interrupted during carrying out the detection of malfunction (during the period from the beginning to the end of the detection of malfunction), i.e., after passing the purge-execution-integrated time after starting the engine (step 513), the foregoing purge-execution-integrated time is cleared. In other words, referring to FIGS. 2, 3, and 4, during the period of time from starting of the detection of malfunction in step 550 to the end of the detection of malfunction in step 570, when the judgment is No in step 503 or when the judgment is No in step 578 or step 579, the purge-execution-integrated time Tps after starting the engine once judged in step 513 is cleared, and the judgment value of the step 513 after the foregoing interruption is changed to a different time (for example, 120 sec) shorter than the value (for example, 200 sec) after starting the engine.

As described above, in the case where detection of malfunction is interrupted after passing the purge-execution-integrated time (or the integrated purge amount) required after starting the engine, the canister is purged for a period of time shorter than the initial required purge-execution-integrated time, and then detection of malfunction is carried out again. As a result, detection of malfunction is carried out at a higher frequency and deterioration in drivability and emission is prevented.

Embodiment 2.

In this Embodiment 2, a judgment value TTPRG (for example, 200 sec) used in the judgment in step 513 in FIG. 2 is appropriately set according to at least one of the fuel tank internal temperature, atmospheric pressure, and amount of remaining fuel (fuel level). TTPRG is set to a value obtained by the following expression:

$$TTPRG = CR \times (1 + CPa + CFL)$$

Figure 7:
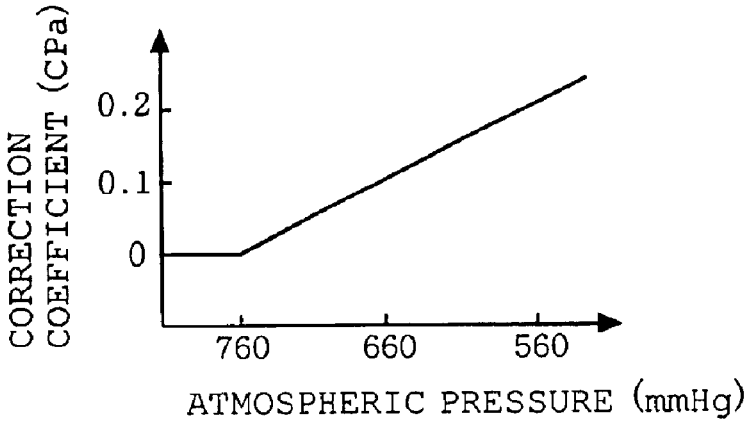
FIG. 7 is a graphic diagram showing a relation between atmospheric pressure and its correction coefficient Cpa.
Figure 8:
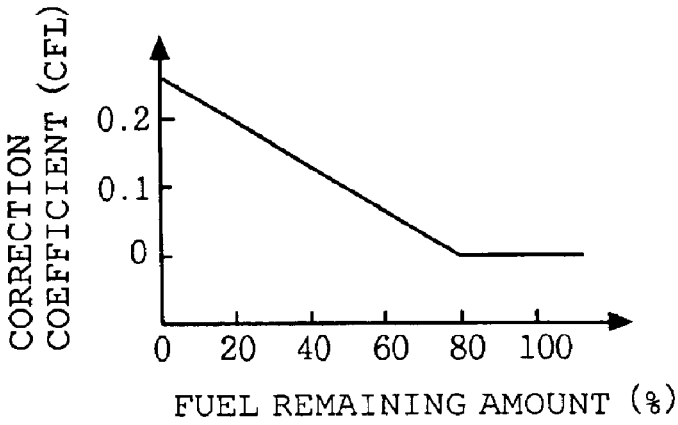
FIG. 8 is a graphic diagram showing a relation between amount of remaining fuel and its correction coefficient CFL.

In this expression, the time (judgment value CR) set according to the fuel tank internal temperature is obtained from, for example, the table in FIG. 6 and set to a time (the judgment value CR) [s] corresponding to the tank internal temperature [°C.]. This is a correction made because amount of fuel evaporation is decreased when the fuel tank internal temperature lowers. Correction using the atmospheric pressure correction coefficient CPa and the fuel remaining amount correction coefficient CFL is made because amount of fuel evaporation is large when the atmospheric pressure or the fuel remaining amount is small, which gives a considerable influence on drivability and exhaust injurious ingredient value. FIG. 7 shows a relation between the atmospheric pressure and its correction coefficient CPa. FIG. 8 shows a relation between the amount of remaining fuel and its correction coefficient CFL. As described above, since the judgment value is appropriately set according to the fuel tank internal temperature, atmospheric pressure, or amount of remaining fuel (the fuel level), the purge-execution-integrated time (or the integrated purge amount) required after starting the engine can be set to an appropriate value.

It is also preferable to apply this Embodiment 2 to the foregoing Embodiment 1 and set the purge-execution-integrated time (or integrated purge amount) required after starting the engine to an appropriate value. In this case, Tps in step 512 in FIG. 2 is shorter than Tps in step 513.

Embodiment 3.

When supplying fuel, the fuel evaporation amount increases without fail due to the fuel supply, and it is therefore necessary to purge the canister 9 more sufficiently than normal. In this Embodiment 3, the purge total time (integrated purge amount) after the fuel supply is established to be longer than that under normal conditions and the canister 9 is sufficiently purged in order to prevent deterioration in drivability and emission.

Figure 9:
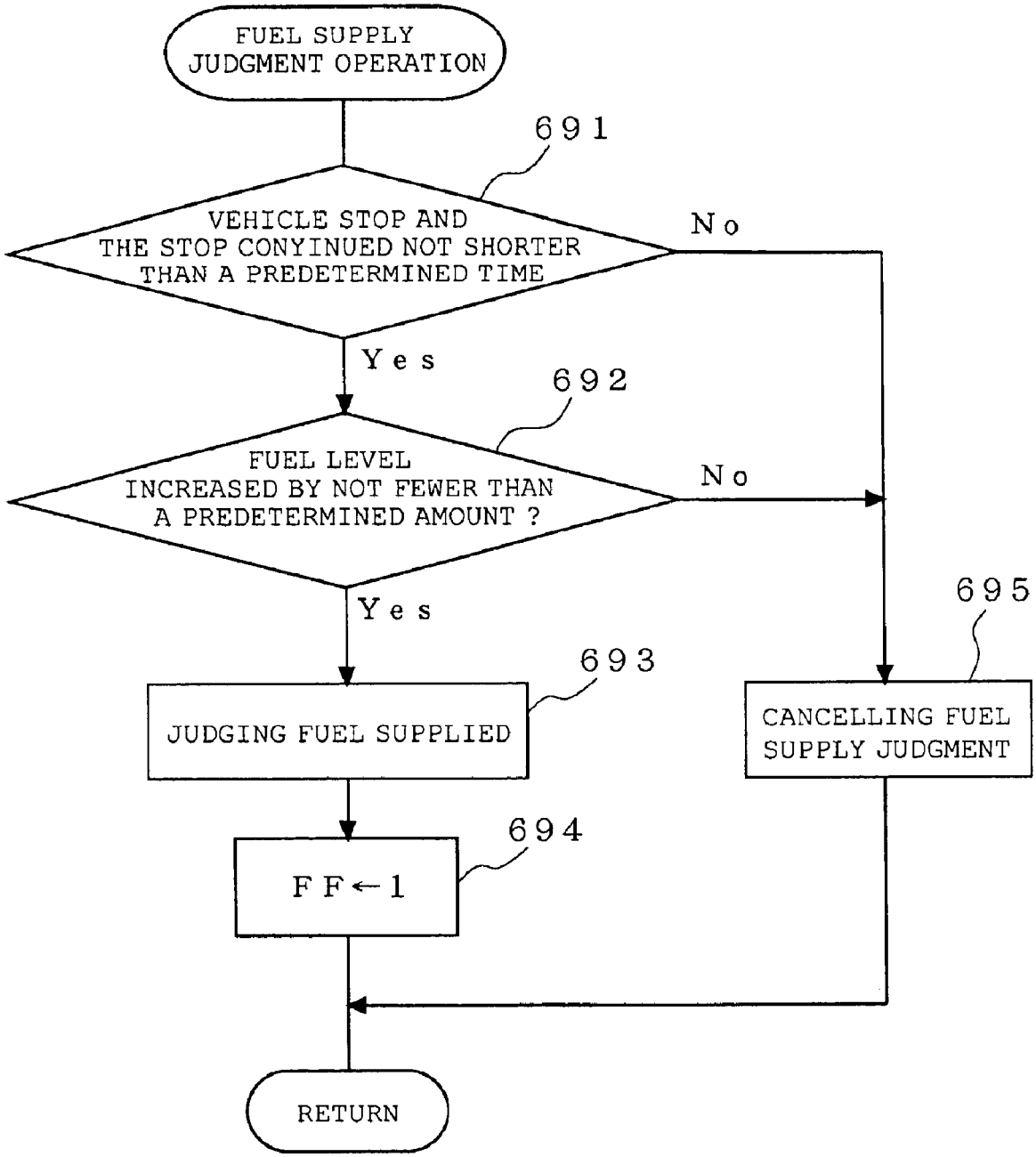
FIG. 9 is a fuel supply judgment flowchart for judging whether or not fuel is supplied according to Embodiment 3.

FIG. 9 is a fuel supply judgment flowchart for judging whether or not fuel is supplied, i.e., whether or not there is any fuel supply. This flowchart works even if the key switch is OFF. When starting fuel supply judgment operation, whether or not the vehicle is stopped or the vehicle stop continues not shorter than a predetermined time is measured in step 691 by a speed sensor 29 or by sensor 29 in association with a timer included in the ECU 20. If it is judged 'Yes', in step 692, the fuel level gauge 27 in association the timer measures whether or not the fuel level has increased by not less than a predetermined amount within a predetermined time. If 'Yes', it is judged that there is any fuel supply in step 693, and the flag is set to be flag FF←1 (there is fuel supply) in step 694, which is stored. Even if fuel supply judgment is repeatedly implemented at, for example, 25 msec and it is judged again that there is any fuel supply, FF=1 (there is fuel supply) remains unchanged. Change to FF←0 is carried out as shown in a flowchart described later. If it is judged 'No' in either step 691 or 692, fuel supply judgment is cancelled in step 695. It is also preferable to detect stop of vehicle by key switch 'OFF'.

Figure 10:
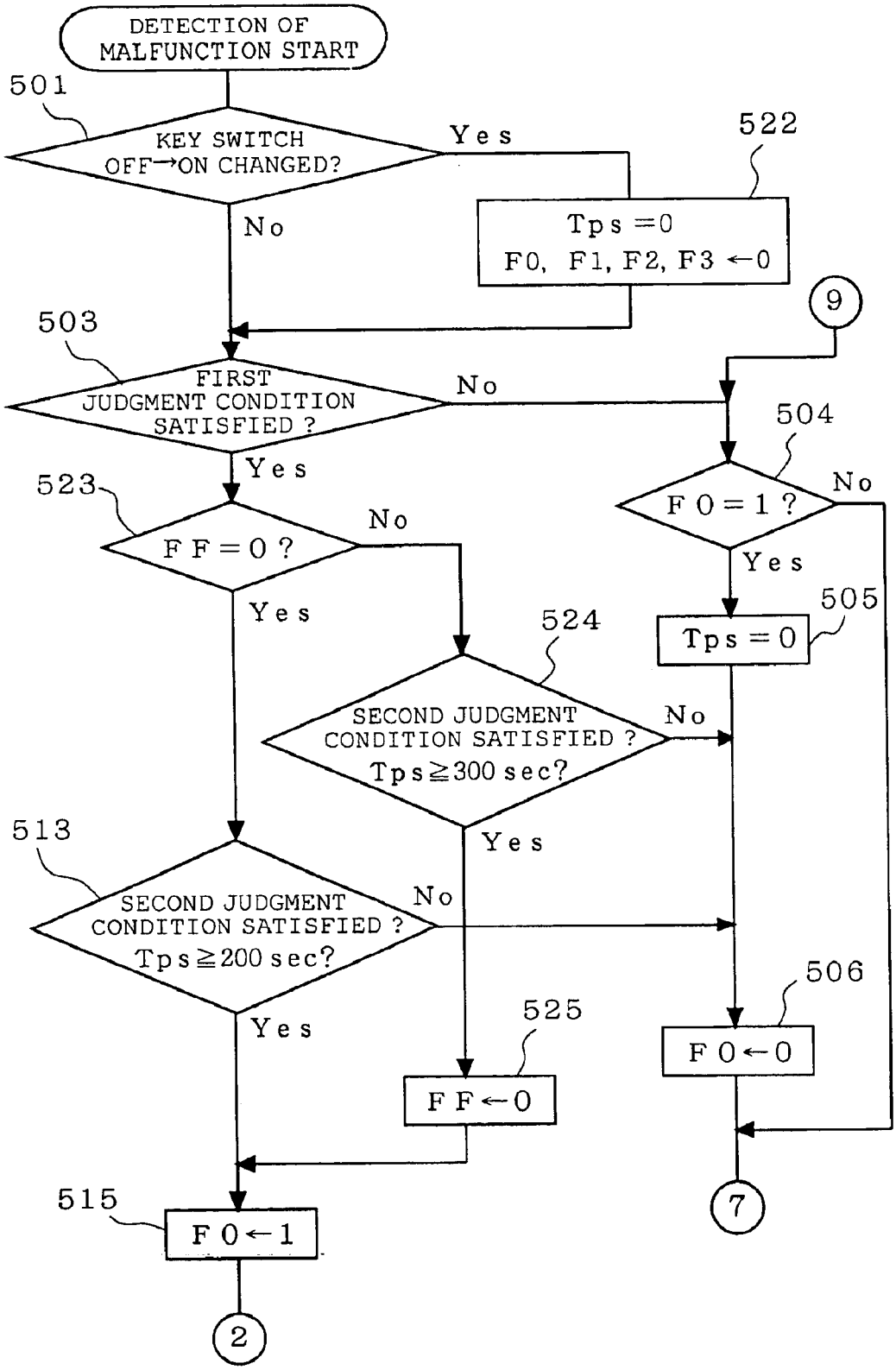
FIG. 10 is a part of a flowchart showing failure diagnosis of the fuel gas purge system according to Embodiment 3.

FIGS. 10, 3 and 4 are flowcharts each showing failure diagnosis of the fuel gas purge system according to Embodiment 3, and FIGS. 10, 3, and 4 form a complete flowchart in combination. FIGS. 3 and 4 are the same as to the foregoing Embodiment 1, and therefore FIG. 10 is mainly referred to explain this flowchart. In FIG. 10, the same reference numerals as those in FIG. 2 indicate the same or equivalent contents or meaning, and the same step numbers as those in FIG. 2 indicate the same or equivalent steps.

Now referring to FIG. 10, when detecting a change from OFF to ON of the key switch is detected (step 501, Yes) to start operation of this failure diagnostic routine (start detection of malfunction), the operation step 522 is carried out, and the process proceeds to step 503.

In step 522, the purge-execution-integrated time and the flags are set to be purge-execution-integrated time Tps=0, and F0, F1, F2, F3→0 where: Tps is a purge-execution-integrated time, and Tps=0 indicates that the purge-execution-integrated time is set to 0.

F0, F1, F2, and F3 are set in the same manner as in the foregoing Embodiment 1.

In step 501, if the key switch is changed from OFF to ON, it is judged 'Yes'. If the key switch continues being ON, it is judged 'No', and the process proceeds to step 503.

In step 503 (the first malfunction judgment condition detecting means), whether or not the first malfunction judgment conditions are satisfied is detected. If the first malfunction judgment conditions (same as those in Embodiment 1) are satisfied, the process proceeds to step 523. If the first malfunction judgment conditions are not satisfied, failure diagnosis is inhibited, and the process proceeds to step 504. On and from step 504, the process proceeds to step 580 (FIG. 4) in the same manner as in the foregoing Embodiment 1, and further proceeding to step 571 in the same manner, this routine comes to end.

When starting the operation of failure diagnostic routine again (detection of malfunction start), if the key switch continues being ON, it is judged 'No' in step 501, and the process proceeds to step 503. If the first malfunction judgment conditions are satisfied (step 503, Yes), whether or not fuel is supplied is determined by checking the flag FF of FIG. 9 in step 523. If FF=0 (fuel is not supplied), the process proceeds to step 513 (the second malfunction judgment condition detecting means), and whether or not the purge-execution-integrated time after starting the engine is not less than a predetermined time (for example, 200 seconds) is judged. If it is judged 'No' in step 513, i.e., if the purge is insufficient, the failure diagnosis is inhibited, and in the same manner as in the foregoing Embodiment 1, the process proceeds from step 506 to step 571, and this routine comes to end.

Next, if the canister 9 is sufficiently purged (step 513, Yes), the flag is set to be F0←1 (detection of malfunction is going on) (step 515), and the routine in FIGS. 3 and 4 is carried out from step 550 in FIG. 3 in the same manner as in the foregoing Embodiment 1. In the meantime, if FF=0, it is judged Yes in step 523. The process proceeds to step 513, and the routine is repeated.

When supplying fuel to the vehicle, the fuel supply is judged by fuel supply judgment operation in FIG. 9, the flag is set to beat FF←1, and this fuel supply is stored. When the key is switched from OFF to ON after the fuel supply, detection of malfunction starts, it is judged Yes in step 501, and the purge-execution-integrated time and the flags are set to be purge-execution-integrated time Tps=0, F0, F1, F2, F3←0 in step 522. Subsequently, when the first malfunction judgment conditions in step 503 are satisfied, the process proceeds to step 523, and the stored value of the flag FF is checked. Since FF=1, it is judged No in step 523, and the process proceeds to step 524. In this step, as the second malfunction judgment conditions, whether or not the purge-execution-integrated time is longer than normal (for example, not shorter than 300 sec or not) is judged. If the purge-execution-integrated time has not reached 300 sec yet, the process proceeds from step 506 to step 571, and this routine comes to end. If the purge-execution-integrated time has reached 300 sec, the flag FF in FIG. 9 is reset to 0 and stored in step 525. The process then proceeds to step 515, and the routine in FIGS. 3 and 4 from step 550 is carried out in the same manner as in the foregoing Embodiment 1.

As described above, in this Embodiment 3, the integrated purge time (integrated purge amount) after fuel supply is longer than that under normal conditions, and failure diagnosis is started after sufficiently purging the canister 9, thereby preventing deterioration in drivability and emission.

It is also preferable to apply the judgment value TTPRG in Embodiment 2 to this Embodiment 3 so that the purge-execution-integrated time (or integrated purge amount) is set to an appropriate value. In this case also, Tps in step 524 in FIG. 10 is longer than Tps in step 513.

Embodiment 4.

In this Embodiment 4, in the case where purge has not been carried out not shorter than a predetermined time, the purge-execution-integrated time up to that time is cleared, and purge-execution-integrated time operation starts afresh. When no purge is carried out, this indicates that the purge duty control amount is 0. When no purge is carried out, this indicates that the engine is idling or that the negative pressure of the intake pipe 5 is too small to introduce purge air even if the purge control valve 10 is fully opened (for example, the engine is running with a heavy load).

Figure 11:
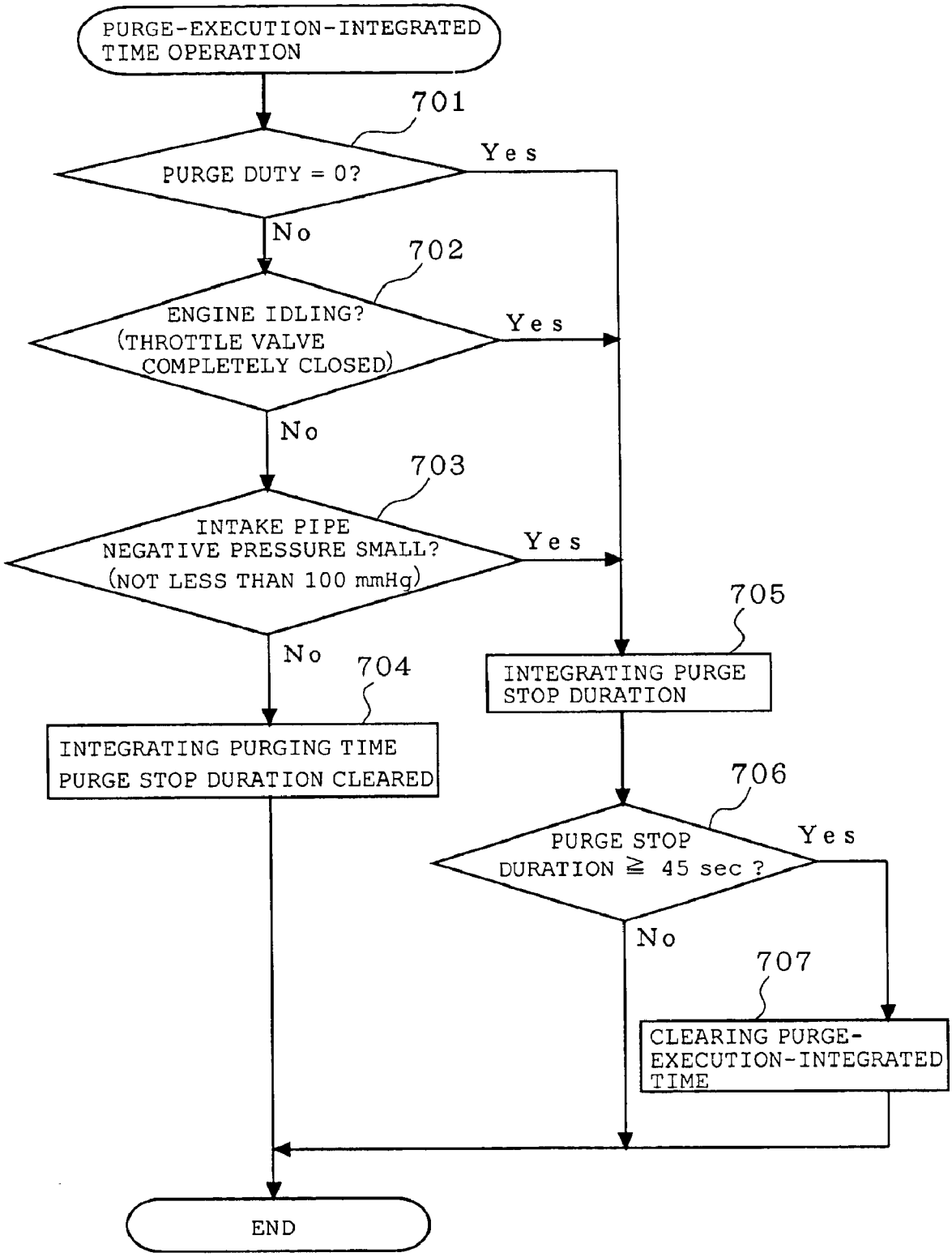
FIG. 11 is a flowchart showing operation (processing) of purge-execution-integrated time according to Embodiment 4.

FIG. 11 is a flowchart showing a purge-execution-integrated time operation according to Embodiment 4. This flowchart is also applicable to the purge-execution-integrated time operation (the integrated purge amount measuring means) in the foregoing Embodiments 1 to 3. When purge-execution-integrated time operation starts, the ECU 20 detects whether or not the purge duty control amount is 0 in step 701, and if the it is detected Yes, the process proceeds to step 705. If it is detected No in step 701, the process proceeds to step 702. In step 702, the throttle-opening sensor 12 detects whether or not the throttle valve 3 is completely closed (the engine is idling), and if it is detected Yes (completely closed), the process proceeds to step 705. If it is detected No in step 702, the process proceeds to step 703. In step 703, the intake pipe pressure sensor 18 detects whether or not the intake pipe negative pressure is small (for example, at most 100 mmHg), and if it is detected Yes, the process proceeds to step 705.

If detected Yes in step 701, 702, or 703, since the purge is stopping or the purge has been stopped, the purge stop duration is integrated in step 705. In step 706, if this purge-stop duration is shorter than, for example, 45 sec (No), the process comes to END, and purge-execution-integrated time operation is carried out again (for example, every 25 msec). If the purge stop duration has reached, for example, 45 sec (Yes) in step 706, the purge-execution-integrated time up to that time is cleared, the process comes to END, and purge-execution-integrated time operation is carried out again.

On the other hand, if it is detected No in step 701, 702, and 703, the purging time is integrated and the purge stop duration up to that time is cleared in step 704. The process comes to END, and purge-execution-integrated time operation is carried out again.

As described above, unless purge has been carried out not shorter than a predetermined time, i.e., when the purge duty control amount is 0, when the engine is idling (the throttle valve is completely closed), or when the negative pressure of the intake pipe is small (for example, 100 mmHg), the situation continuing not shorter than a predetermined time, then the foregoing purge-execution-integrated time is cleared.

This is because, when no purge has been carried out over a predetermined time, amount of fuel evaporation is increased. By carrying out operation of the detection of malfunction at this point of time, it becomes possible to prevent a negative influence upon the internal combustion engine. Therefore, in the case where detection of malfunction starts with the canister insufficiently purged and the purge control valve is opened to introduce the intake pipe negative pressure into the fuel gas purge system, this system prevents the intake pipe from a relatively large amount of fuel evaporative gas remaining in the canister from flowing into. As a result, it is possible to prevent deterioration in drivability and emission caused by the over-rich mixture.

While the presently preferred embodiments of the present invention have been shown and described, it is to be understood that these disclosures are for the purpose of illustration and that various changes and modifications may be made without departing from the scope of the invention as set forth in the appended claims.

What is claimed is:

1. A fuel gas purge system having failure diagnostic function in an internal combustion engine comprising:

a fuel transpiration-preventing device that adsorbs fuel gas produced in a fuel tank into an adsorbent of a canister disposed in the middle of a purge passage communicating the fuel tank to an intake pipe and opens and closes a purge control valve based on operating conditions of the internal combustion engine in order to introduce the adsorbed fuel gas into the intake pipe, thereby preventing transpiration of fuel;

plural sensors that detect operating conditions of said internal combustion engine;

first malfunction judgment condition detecting means that detects satisfaction of first malfunction judgment conditions of said fuel transpiration-preventing device on the basis of operating condition information from said plural sensors;

an atmospheric air port blocking valve that blocks an atmospheric air port disposed on said canister;

sealing means that closes both of said purge control valve and said atmospheric air port blocking valve and transforms said fuel transpiration-preventing device into a hermetically sealed section as a whole;

integrated purge amount measuring means that measures a integrated purge amount on the basis of an integrated time during which said purge control valve is subject to open control or a purge integrated flow rate based on said open control;

second malfunction judgment condition detecting means that detects that second malfunction judgment conditions are satisfied when said first malfunction judgment conditions are satisfied and the integrated purge amount after starting the internal combustion engine is not less than a first predetermined value;

a fuel tank internal pressure sensor that detects an internal pressure in said fuel tank; and malfunction detecting means that detects any malfunction in said fuel transpiration-preventing device on the basis of a result detected by said fuel tank internal pressure sensor;

wherein, when the detection of malfunction is interrupted after said second malfunction judgment conditions are satisfied, said integrated purge amount is cleared, and the next second malfunction judgment conditions are determined satisfied when said integrated purge amount is not less than a second predetermined value that is shorter than said first predetermined value.

2. The fuel gas purge system having failure diagnostic function in an internal combustion engine according to claim 1, wherein said plural sensors include at least one of an atmospheric pressure sensor for detecting the atmospheric pressure, a fuel tank internal temperature sensor for detecting said fuel tank internal temperature and a fuel level gauge for detecting an amount of fuel remaining in said fuel tank, and a first predetermined value of said second malfunction judgment condition detecting means is a value in which said integrated purge amount after starting of the internal combustion engine is conforming to at least one of the atmospheric pressure, the fuel tank internal temperature, and the fuel level.

3. The fuel gas purge system having failure diagnostic function in an internal combustion engine according to claim 2, further comprising means for clearing said integrated purge amount in a case where a period of time, during which any purge air is not introduced by said purge control valve, continues not shorter than a predetermined time.

4. The fuel gas purge system having failure diagnostic function in an internal combustion engine according to claim 1, further comprising means for clearing said integrated purge amount in a case where a period of time, during which any purge air is not introduced by said purge control valve, continues not shorter than a predetermined time.

5. A fuel gas purge system having failure diagnostic function in an internal combustion engine comprising:

a fuel transpiration-preventing device that adsorbs fuel gas produced in a fuel tank into an adsorbent of a canister disposed in the middle of a purge passage communicating the fuel tank to an intake pipe and opens and closes a purge control valve based on operating conditions of the internal combustion engine in order to introduce the adsorbed fuel gas into the intake pipe, thereby preventing transpiration of fuel;

plural sensors that detect operating conditions of said internal combustion engine;

first malfunction judgment condition detecting means that detects satisfaction of first malfunction judgment conditions of said fuel transpiration-preventing device on the basis of operating condition information from said plural sensors;

an atmospheric air port blocking valve that blocks an atmospheric air port disposed on said canister;

sealing means that closes both of said purge control valve and said atmospheric air port blocking valve and transforms said fuel transpiration-preventing device into a hermetically sealed section as a whole;

integrated purge amount measuring means that measures a integrated purge amount on the basis of an integrated time during which said purge control valve is subject to open control or a purge integrated flow rate based on said open control;

second malfunction judgment condition detecting means that detects that second malfunction judgment conditions are satisfied when said first malfunction judgment conditions are satisfied and the integrated purge amount after starting the internal combustion engine is not less than a first predetermined value;

a fuel tank internal pressure sensor that detects an internal pressure in said fuel tank;

malfunction detecting means that detects any malfunction in said fuel transpiration-preventing device on the basis of a result detected by said fuel tank internal pressure sensor; and fuel supply judging means;

wherein, if said fuel supply judging means judges that fuel has been supplied, said second malfunction judgment conditions are judged satisfied when said integrated purge amount is not less than a second predetermined value that is not shorter than said first predetermined value.

6. The fuel gas purge system having failure diagnostic function in an internal combustion engine according to claim 5, wherein said means for judging fuel supply includes a speed sensor for detecting a speed of the vehicle, a fuel level gauge for detecting an amount of fuel remaining in said fuel tank and a timer, and judges supply of fuel.

7. The fuel gas purge system having failure diagnostic function in an internal combustion engine according to claim 6, further comprising means for clearing said integrated purge amount in a case where a period of time, during which any purge air is not introduced by said purge control valve, continues not shorter than a predetermined time.

8. The fuel gas purge system having failure diagnostic function in an internal combustion engine according to claim 5, further comprising means for clearing said integrated purge amount in a case where a period of time, during which any purge air is not introduced by said purge control valve, continues not shorter than a predetermined time.

9. A fuel gas purge system having failure diagnostic function in an internal combustion engine comprising:

a fuel transpiration-preventing device that adsorbs fuel gas produced in a fuel tank into an adsorbent of a canister disposed in the middle of a purge passage communicating the fuel tank to an intake pipe and opens and closes a purge control valve based on operating conditions of the internal combustion engine in order to introduce the adsorbed fuel gas into the intake pipe, thereby preventing transpiration of fuel;

plural sensors that detect operating conditions of said internal combustion engine;

first malfunction judgment condition detecting means that detects satisfaction of first malfunction judgment conditions of said fuel transpiration-preventing device on the basis of operating condition information from said plural sensors;

an atmospheric air port blocking valve that blocks an atmospheric air port disposed on said canister;

sealing means that closes both of said purge control valve and said atmospheric air port blocking valve and transforms said fuel transpiration-preventing device into a hermetically sealed section as a whole;

integrated purge amount measuring means that measures a integrated purge amount on the basis of an integrated time during which said purge control valve is subject to open control or a purge integrated flow rate based on said open control;

second malfunction judgment condition detecting means that detects that second malfunction judgment conditions are satisfied when said first malfunction judgment conditions are satisfied and the integrated purge amount after starting the internal combustion engine is not less than a first predetermined value;

a fuel tank internal pressure sensor that detects an internal pressure in said fuel tank;

malfunction detecting means that detects any malfunction in said fuel transpiration-preventing device on the basis of a result detected by said fuel tank internal pressure sensor; and means for clearing said integrated purge amount in a case where a period of time, during which any purge air is not introduced by said purge control valve, continues not shorter than a predetermined time.

* * * * *